US009038819B2

(12) United States Patent
Perelli

(10) Patent No.: US 9,038,819 B2
(45) Date of Patent: May 26, 2015

(54) WEARABLE CLEANING ARTICLES AND CONTAINER

(71) Applicant: L&F Innoventions, LLC, Naples, FL (US)

(72) Inventor: Thomas Perelli, Raleigh, NC (US)

(73) Assignee: L&F Innoventions, LLC, Naples, FL (US)

( * ) Notice: Subject to any disclaimer, the term of this patent is extended or adjusted under 35 U.S.C. 154(b) by 0 days.

(21) Appl. No.: 13/925,317

(22) Filed: Jun. 24, 2013

(65) Prior Publication Data

US 2013/0341212 A1 Dec. 26, 2013

Related U.S. Application Data

(60) Provisional application No. 61/663,051, filed on Jun. 22, 2012.

(51) Int. Cl.

| | |
|---|---|
| ***B08B 3/04*** | (2006.01) |
| ***B67D 7/02*** | (2010.01) |
| ***B65D 81/22*** | (2006.01) |
| ***B05B 11/00*** | (2006.01) |
| ***B65D 1/40*** | (2006.01) |
| ***B65D 90/02*** | (2006.01) |
| ***B65D 1/06*** | (2006.01) |

(Continued)

(52) U.S. Cl.

CPC ..... *B08B 3/04* (2013.01); *B67D 7/0288* (2013.01); *B65D 81/22* (2013.01); *B05B 11/0037* (2013.01); *B65D 1/40* (2013.01); *B65D 90/027* (2013.01); *B65D 1/06* (2013.01); *B05B 11/0056* (2013.01); *B05B 11/3057* (2013.01); *B05B 15/005* (2013.01); *B05B 15/061* (2013.01); *B05B 15/065* (2013.01); *A47L 13/22* (2013.01)

(58) Field of Classification Search

CPC ..... B05B 11/0037; B05B 11/0056; B05B 11/3057; B05B 15/061; B05B 15/065; B05B 15/005; B08B 3/04; B65D 1/06; B65D 1/40; B65D 81/22; B65D 90/027; B67D 7/0288; A47L 13/22

USPC ..... 206/278, 425, 438, 570; 2/159–163; 15/104.94; 221/45, 46

See application file for complete search history.

(56) References Cited

U.S. PATENT DOCUMENTS

| | | | |
|---|---|---|---|
| 3,926,341 | A | 12/1975 | Lhoest |
| 4,035,004 | A | 7/1977 | Hengesbach |

(Continued)

OTHER PUBLICATIONS

Non-final Office Action mailed Jun. 26, 2013 for U.S. Appl. No. 12/895,982.

*Primary Examiner* — Bryon Gehman

(74) *Attorney, Agent, or Firm* — NKK Patent Law, PLLC

(57) ABSTRACT

A container has a base and walls connected to the base to define an interior space. The walls have upper edges that terminate in a plane and define an opening for access to the interior space. Wetted donnable articles are stacked within the container, each article in a flat configuration at least partially perpendicular to the opening permitting withdrawal of any one of the donnable articles through the opening in a flat configuration. Walls on opposing sides of the base of the container diverge from each other with increasing distance from the base, such that the interior space widens gradually toward the opening. Walls on other opposing sides of the base have lower portions connected to the base and upper portions connected to the lower portions by steps that lengthen the interior space abruptly.

18 Claims, 4 Drawing Sheets

(51) Int. Cl.

| | |
|---|---|
| ***B05B 15/06*** | (2006.01) |
| ***A47L 13/22*** | (2006.01) |
| *B05B 15/00* | (2006.01) |

(56) References Cited

U.S. PATENT DOCUMENTS

| | | | | | |
|---|---|---|---|---|---|
| 4,256,154 | A | | 3/1981 | Black | |
| 4,558,821 | A | | 12/1985 | Tada et al. | |
| 4,618,076 | A | | 10/1986 | Silvenis | |
| 4,689,935 | A | * | 9/1987 | Harding | 206/438 |
| 4,705,191 | A | | 11/1987 | Itzel et al. | |
| 4,781,311 | A | | 11/1988 | Dunning et al. | |
| 4,788,733 | A | * | 12/1988 | Lerner | 15/104.94 |
| 4,830,235 | A | | 5/1989 | Miller | |
| 4,844,293 | A | * | 7/1989 | McLaughlin | 206/278 |
| 4,925,066 | A | | 5/1990 | Rosenbaum | |
| 5,031,798 | A | | 7/1991 | Wild | |
| 5,056,685 | A | | 10/1991 | Wild | |
| 5,083,678 | A | | 1/1992 | Waring | |
| 5,152,431 | A | | 10/1992 | Gardner et al. | |
| 5,156,295 | A | | 10/1992 | Gordon et al. | |
| 5,156,299 | A | | 10/1992 | De Caluwe et al. | |
| 5,160,071 | A | | 11/1992 | Wright | |
| 5,174,458 | A | | 12/1992 | Segati | |
| 5,190,152 | A | * | 3/1993 | Smith et al. | 206/425 |
| 5,195,664 | A | | 3/1993 | Rhea | |
| 5,244,125 | A | | 9/1993 | Robbins, III | |
| 5,251,820 | A | | 10/1993 | Ho | |
| 5,328,055 | A | | 7/1994 | Battle | |
| 5,337,921 | A | | 8/1994 | Wilson et al. | |
| 5,398,846 | A | | 3/1995 | Corba et al. | |
| 5,421,485 | A | | 6/1995 | Furuta et al. | |
| 5,429,254 | A | | 7/1995 | Christine | |
| 5,439,141 | A | | 8/1995 | Clark et al. | |
| 5,472,119 | A | | 12/1995 | Park et al. | |
| 5,474,212 | A | | 12/1995 | Ichikawa et al. | |
| 5,478,015 | A | | 12/1995 | Black | |
| 5,542,581 | A | | 8/1996 | Habora et al. | |
| 5,558,257 | A | | 9/1996 | Braun | |
| 5,655,682 | A | * | 8/1997 | Hoffrichter | 221/45 |
| 5,718,383 | A | | 2/1998 | Smith et al. | |
| 5,836,479 | A | | 11/1998 | Klima et al. | |
| 5,839,616 | A | | 11/1998 | Irwin et al. | |
| 5,871,122 | A | | 2/1999 | Klima et al. | |
| 5,890,624 | A | | 4/1999 | Klima et al. | |
| 5,931,304 | A | * | 8/1999 | Hammond | 206/570 |
| 5,934,462 | A | * | 8/1999 | Gregory | 206/278 |
| 5,934,519 | A | | 8/1999 | Kim et al. | |
| 5,944,223 | A | | 8/1999 | Klima et al. | |
| 5,947,332 | A | | 9/1999 | Klima, Jr. et al. | |
| 5,979,715 | A | | 11/1999 | Emrick | |
| 5,984,199 | A | | 11/1999 | Restive | |
| 6,027,041 | A | | 2/2000 | Evans | |
| 6,059,152 | A | | 5/2000 | Mayfield | |
| 6,123,230 | A | | 9/2000 | Klima, Jr. et al. | |
| 6,179,142 | B1 | | 1/2001 | Hansen | |
| 6,206,243 | B1 | | 3/2001 | Schneider et al. | |
| 6,213,358 | B1 | | 4/2001 | Libit et al. | |
| 6,250,511 | B1 | | 6/2001 | Kelly | |
| 6,253,993 | B1 | | 7/2001 | Lloyd et al. | |
| 6,319,453 | B1 | | 11/2001 | Klima, Jr. et al. | |
| 6,345,774 | B1 | | 2/2002 | Calhoun | |
| 6,394,319 | B1 | | 5/2002 | Pucillo | |
| 6,409,103 | B1 | | 6/2002 | Norville et al. | |
| 6,460,702 | B2 | * | 10/2002 | Hammond | 206/570 |
| 6,530,108 | B1 | | 3/2003 | Brown et al. | |
| 6,540,109 | B1 | | 4/2003 | Klima et al. | |
| 6,543,642 | B1 | * | 4/2003 | Milliorn | 206/438 |
| 6,588,590 | B1 | * | 7/2003 | Wang | 206/425 |
| 6,631,830 | B2 | | 10/2003 | Ma et al. | |
| 6,659,670 | B1 | | 12/2003 | Blouse | |
| 6,732,958 | B2 | | 5/2004 | Norville et al. | |
| 6,748,605 | B1 | * | 6/2004 | Brinkmann | 2/161.6 |
| 6,789,303 | B2 | | 9/2004 | Maas et al. | |
| 6,833,072 | B1 | | 12/2004 | Krestine et al. | |
| 6,834,815 | B2 | | 12/2004 | Appleby | |
| 6,957,738 | B2 | * | 10/2005 | Hammond | 206/570 |
| 7,040,510 | B1 | | 5/2006 | Hester | |
| 7,251,839 | B2 | | 8/2007 | Bell | |
| 7,478,738 | B2 | | 1/2009 | Hood et al. | |
| 7,520,447 | B2 | | 4/2009 | Engelen et al. | |
| 7,581,273 | B2 | | 9/2009 | Dobrin et al. | |
| 7,648,083 | B2 | | 1/2010 | Hornsby et al. | |
| 7,717,306 | B2 | | 5/2010 | White, Sr. | |
| 8,157,131 | B2 | | 4/2012 | Sim | |
| 8,356,378 | B1 | * | 1/2013 | Crooms | 15/104.94 |
| 2001/0011661 | A1 | | 8/2001 | Klima et al. | |
| 2002/0031625 | A1 | | 3/2002 | Klima, Jr. et al. | |
| 2003/0038186 | A1 | | 2/2003 | Klima et al. | |
| 2004/0035819 | A1 | | 2/2004 | Dennison | |
| 2004/0104194 | A1 | | 6/2004 | Dennison | |
| 2004/0245208 | A1 | | 12/2004 | Dennison | |
| 2005/0167442 | A1 | | 8/2005 | Cuisinier | |
| 2006/0143847 | A1 | | 7/2006 | Vinson et al. | |
| 2006/0237485 | A1 | | 10/2006 | An | |
| 2007/0215645 | A1 | | 9/2007 | Clynes et al. | |
| 2007/0235472 | A1 | | 10/2007 | McFarland | |
| 2008/0011779 | A1 | | 1/2008 | Klima et al. | |
| 2008/0279611 | A1 | | 11/2008 | Graphenious | |
| 2008/0315018 | A1 | | 12/2008 | Withers | |
| 2009/0212077 | A1 | | 8/2009 | Carden | |
| 2009/0277928 | A1 | | 11/2009 | Bruckner | |
| 2010/0096414 | A1 | | 4/2010 | Dennis | |
| 2010/0096415 | A1 | | 4/2010 | Dennis | |
| 2011/0062185 | A1 | | 3/2011 | McFarland | |
| 2011/0121039 | A1 | | 5/2011 | Dennis | |
| 2011/0158740 | A1 | | 6/2011 | Kandasamy et al. | |
| 2011/0180101 | A1 | | 7/2011 | Konishi et al. | |
| 2011/0180619 | A1 | | 7/2011 | Konishi et al. | |

* cited by examiner

WEARABLE CLEANING ARTICLES AND CONTAINER

CROSS-REFERENCE TO RELATED APPLICATION

This patent application claims the benefit of priority of U.S. Provisional Patent Application No. 61/663,051, filed on Jun. 22, 2012, and entitled "Spray Bottle Apparatuses and Associated Accessories." The above-referenced provisional patent application is incorporated herein in entirety by this reference.

TECHNICAL FIELD

The present disclosure relates to cleaning articles and containment arrangements for such articles. More particularly, the present disclosure relates to wetted donnable articles stacked in a container in an easy-access arrangement.

BACKGROUND

Cleaning supplies currently available include pre-moistened towelletes in rolled configurations in cylindrical containers known as "wipes." An individual wipe is generally not intended for extended use, and thus many would be needed for all but the smallest of cleaning tasks. Thus, bigger spills and messes tend to be addressed with a mop and bucket, and medium tasks tend to be addressed with moistened hand towels or rags. In either case, currently available provisions are not particularly convenient. Mops and buckets can be difficult to wield in any space other than large open floor areas. They also tend to require extensive cleaning efforts themselves, requiring a secondary cleaning task once soiled in addressing a primary cleaning task. Using hand towels, whether paper towels or fabric towels are used, involves secondary inconveniences as well. Dispatched to a cleaning task, a worker may first have to visit a sink or carry a spray bottle to a spill area. A hand towel can be easily dropped, which typically prohibits immediate further use of the towel due to soiling or procedural policies.

SUMMARY

This Summary is provided to introduce in a simplified form a selection of concepts that are further described below in the Detailed Descriptions. This Summary is not intended to identify key features or essential features of the claimed subject matter, nor is it to be construed as limiting the scope of the claimed subject matter.

An assembly according to at least one embodiment includes a container having a base and walls connected to the base to define an interior space. The walls have upper edges that terminate in a plane and define an opening for access to the interior space. Wetted donnable articles are stacked within the container, each article in a flat configuration at least partially perpendicular to the opening permitting withdrawal of any one of the donnable articles through the opening in a flat configuration.

In at least one example, at least one donnable article is configured for donning upon the hand of a user. The donnable article may be wetted with a cleaning liquid. The donnable article may include a cleaning mitt having an open wrist band and a palm area for receiving the palm of the hand of a user through the open wrist band, with the wrist band is in a dry condition relative to the palm area. The donnable article includes two planar panels joined together along a peripheral edge forming a partial enclosure open along a terminal wrist band, a palm area connected to the wrist band for receiving a palm of a hand of a user, a thumb area extending from the palm area, and a finger area extending from the palm area.

One or more separable tabs may be breakably attached to the wrist band and connected to the container. There may be two separable tabs, each breakably attached to a respective lateral side of the wrist band by a perforated tearable line. Each tab may have a mounting hole by which the tab is connected to the container. The open wrist bands, in at least one example, are oriented toward the opening of the container.

In at least one example, walls on opposing sides of the base of the container diverge from each other with increasing distance from the base, such that the interior space widens gradually toward the opening. Walls on opposing sides of the base may have lower portions connected to the base and upper portions connected to the lower portions by steps that lengthen the interior space abruptly.

An assembly according to at least one embodiment includes a container having a horizontal base and at least partially vertical walls connected to the base to define an interior space. The walls have upper edges that terminate at an opening for access to the interior space. Wetted articles within the container hang in respective vertical planes and are individually accessible through the opening permitting withdrawal of any one of the articles through the opening in a flat configuration.

In at least one example, the articles fill a horizontal dimension of the interior space of the container between the lower wall portions. In at least one example, the articles do not fill a horizontal dimension of the interior space between the upper wall portions, such that open spaces in the interior space are above the steps. Each article may hang in a respective vertical plane perpendicular to the horizontal dimension.

BRIEF DESCRIPTION OF THE DRAWINGS

The foregoing summary, as well as the following detailed description of preferred embodiments, is better understood when read in conjunction with the appended drawings. For the purposes of illustration, there is shown in the drawings exemplary embodiments; however, the presently disclosed invention is not limited to the specific methods and instrumentalities disclosed.

DETAILED DESCRIPTIONS

While the disclosure of the technology herein is presented with sufficient details to enable one skilled in this art to practice the invention, it is not intended to limit the scope of the disclosed technology. The inventor(s) contemplate that future technologies may facilitate additional embodiments of the presently disclosed subject matter as claimed herein. Moreover, although the term "step" may be used herein to connote different aspects of methods employed, the term should not be interpreted as implying any particular order among or between various steps herein disclosed unless and except when the order of individual steps is explicitly described.

Figure 1:
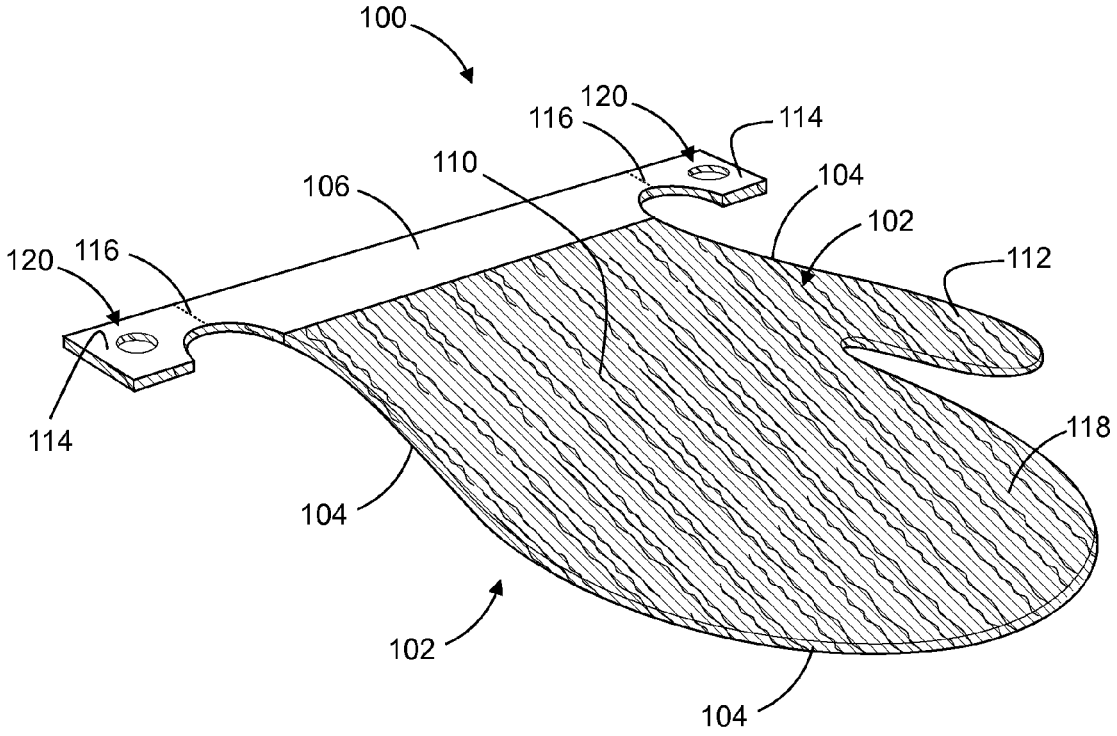
FIG. 1 is a perspective view of a donnable article according to at least one embodiment.

A donnable and wearable article 100, according to at least one embodiment, is illustrated in FIG. 1. The article 100 is illustrated as a mitt for donning upon the hand of a user, and may, for example, be useful for wearing while cleaning surfaces such as counter tops and fixtures such as water faucets and other structures in kitchens, restrooms, and other home and business areas. In the illustrated embodiment, the article 100 includes two planar panels 102 joined together along a curvilinear peripheral edge 104 for a partial enclosure open along a terminal wrist band 106. The article 100 has a palm area 110, for receiving the palm of the hand of a user, and a thumb area 112 extending from the palm area 110. A consolidated four-finger area 118 extends from the palm area 110 for receiving the fingers of a user. Both left and right-hand donning and use are enabled by the illustrated embodiment, as either of the two planar panels 102 can correspond to the palm of a human hand wearing the article 100 with the thumb area 112 oriented to receive the thumb of either a left or right hand. In another embodiment otherwise within the scope of these descriptions, a cleaning article is configured as a fingered glove. Whether embodied as a mitt as illustrated or a fingered glove, the donnable article 100 is donned by passing a human hand through the open wrist band 106 and occupying the interior areas of the article with corresponding portions of the hand.

Each panel 102 includes, along the exterior of the article 100, a fluid permeable outer surface material that is porous or otherwise susceptible to partial or complete liquid or gel saturation. The fluid permeable material along the exterior of the article 100 is furthermore permissive to release liquid or gel onto surfaces upon contact with the article 100. The fluid permeable material can be a woven or non-woven textile, containing natural and synthetic fibers, and can have a monolayer or multi-layered structure. The fluid permeable material can include terry cloth or other moisture absorbent pile cloth, natural sponge material, and synthetic sponge material. The fluid permeable material can be structured as an ordered matrix, a disordered fill, a continuous film, and an aggregate layer of bonded particles. A fluid-impermeable internal liner or surface material may be included along interior sides of the planar panels 102 forming a fluid boundary to protect a hand within the interior of the article when donned. In such an example, the internal layer may serve as a structural substrate to which an outer surface material is applied. In at least one example, the donnable article 100 is provided pre-moistened, wetted or saturated with a selected liquid or gel such as a soap, a solvent, an oil, or any desired fluid or flowable substance. The article 100 may be provided with the same substance or different substances wetting the two panels 102. For example, a double-sided article having the same cleaning solution on both sides may be provided, or a clean-and-dry article may be provided with one side wetted with solution and another side provided dry. Each article may be provided with the same or different outer surface textures or types on its two major sides. In one example, one palm area 110 has a soft spongy texture and the opposite palm area of the same mitt has a fibrous abrasive texture. It is expected that each article 100 will meet a greater range of uses than a typical available wet wipe with regard to both the duration and diversity of use.

The donnable article 100 includes mounting structures illustrated as separable tabs 114 attached to lateral sides of the wrist band 106 by breakable perforated tear lines 116. Each tab 114 is illustrated as having a mounting hole 120 for receiving a rod, a post, a pin or other member for mounting and/or hanging the donnable article 100. Multiple donnable articles 100 may be provided together as a product offering and may be grouped within a container.

Figure 2:
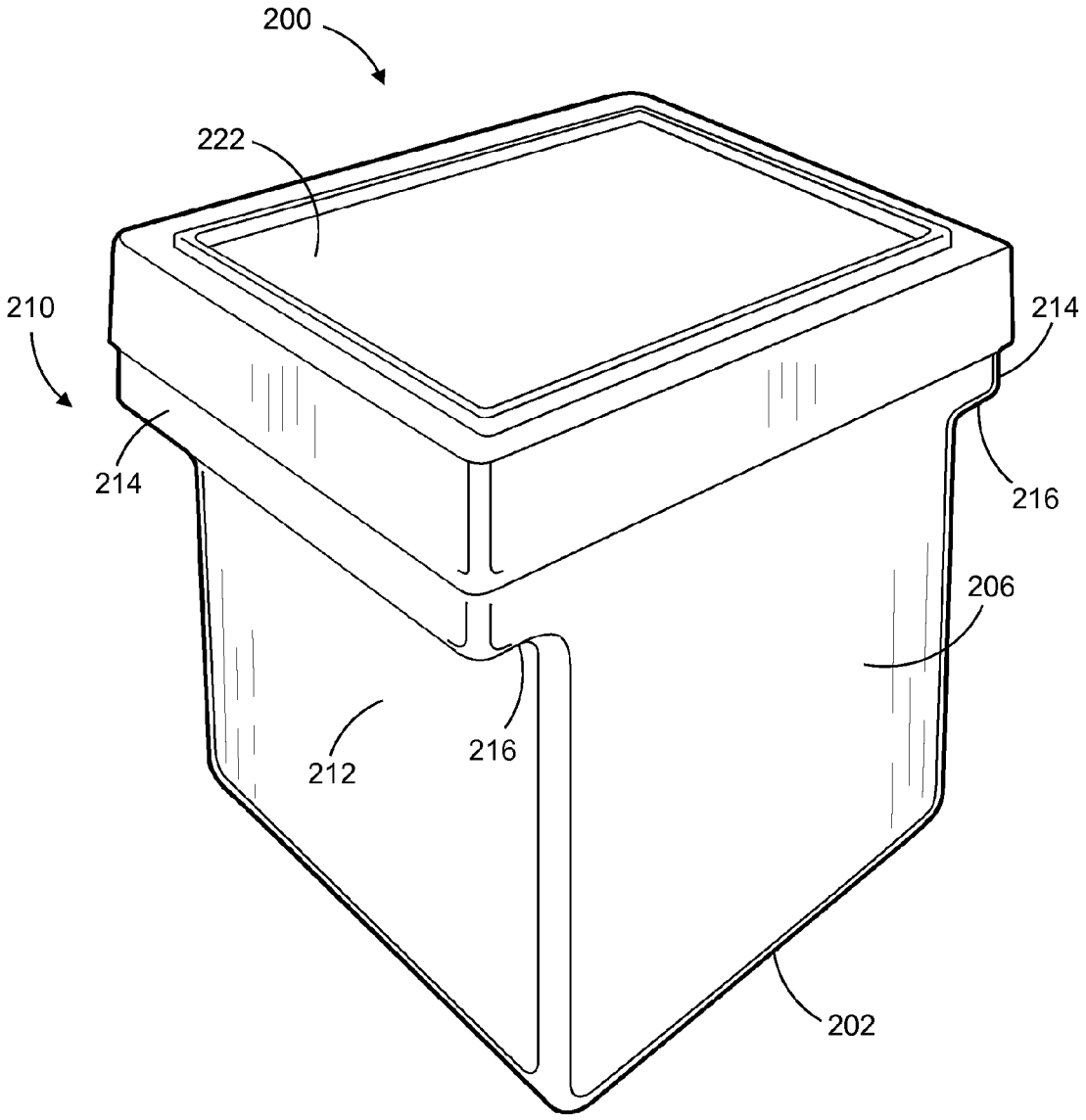
FIG. 2 is a perspective view of a container according to at least one embodiment.
Figure 3A:
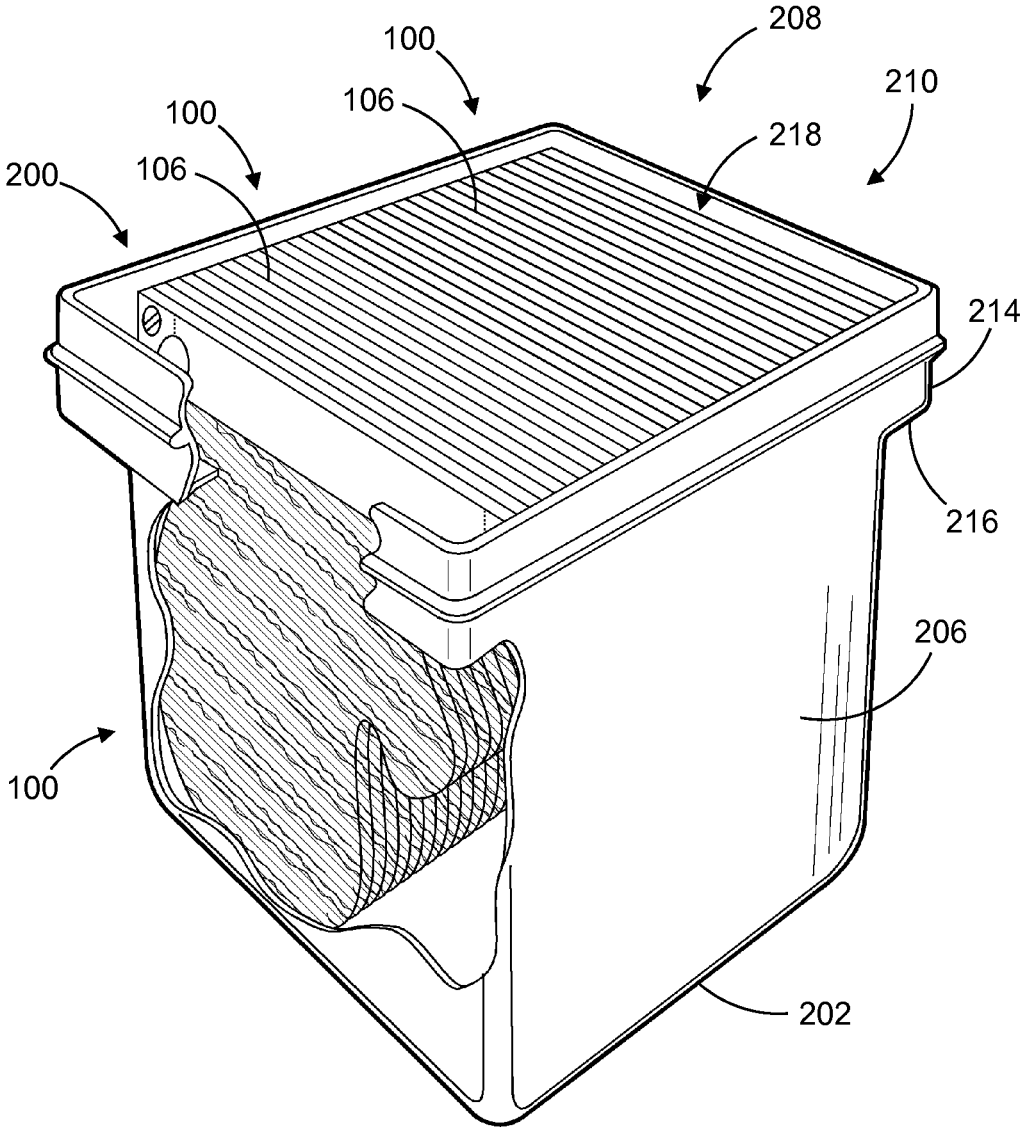
FIG. 3A is a perspective view of multiple donnable articles of FIG. 1 in an exemplary arrangement within the container of FIG. 2.
Figure 3B:
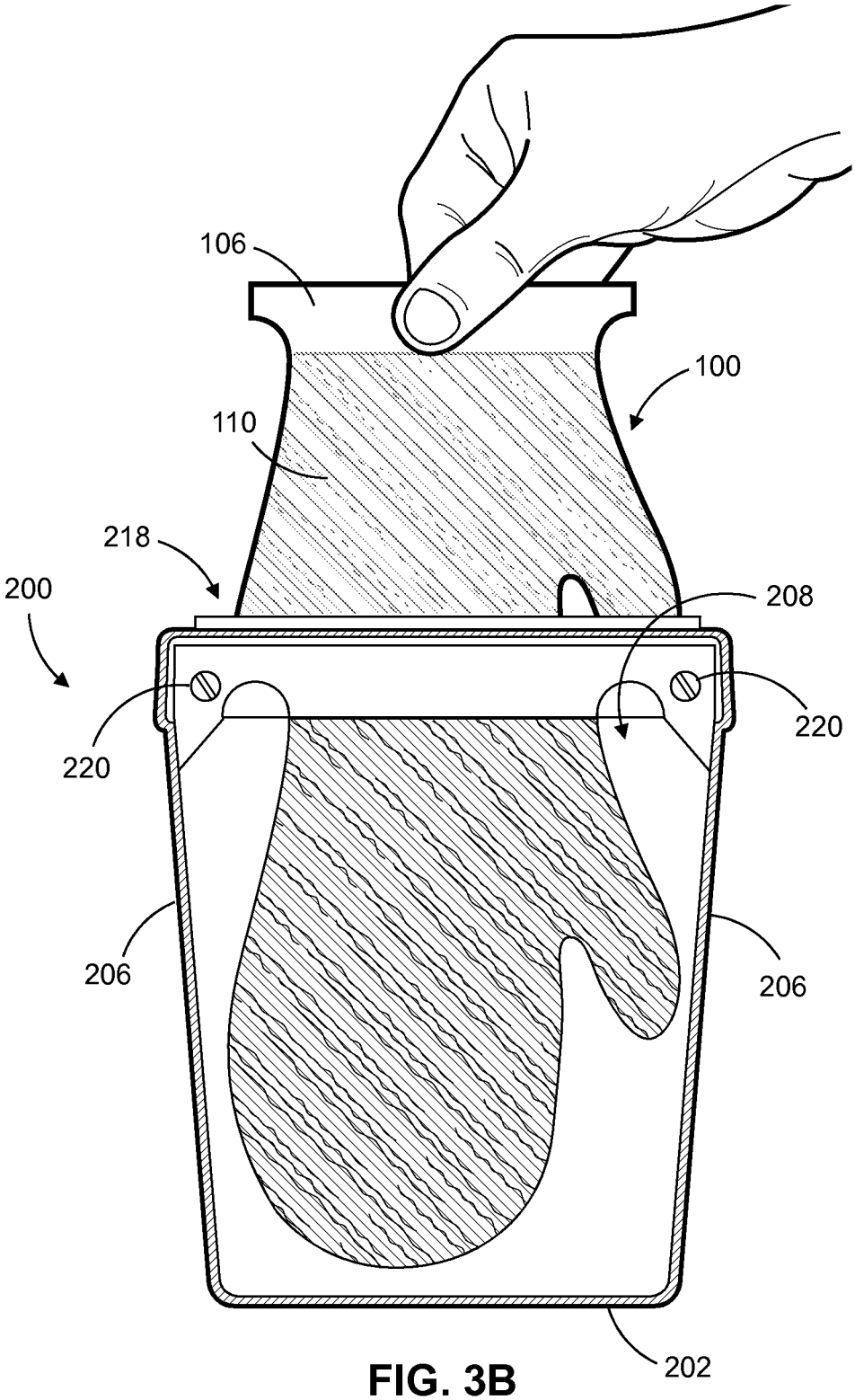
FIG. 3B is a perspective view of the donnable articles in the exemplary arrangement within the container of FIG. 3.

For example, a container 200 according to at least one embodiment is shown in FIG. 2. The container is sufficiently rigid to be self-supporting and to support many articles 100 in a dry condition, a wetted condition, a saturated condition, or even in standing solution. The container 200 has a generally rectangular horizontal base 202 and vertically inclined lateral walls 206 connected to the base. The walls 206 on opposing sides of the base 202 diverge from each other with increasing distance from the base 202, as shown in FIG. 3B, such that the interior space 208 within the container widens toward the top of the container. By this feature, a horizontal cross-section of the interior space 208 with the container 200 widens gradually between the lateral walls 206 as the cross-section is taken at increasing distances from the base 202.

Stepped longitudinal end walls 210 of the container 200 have generally vertical longitudinal end wall lower portions 212 connected to the base 202 and generally vertical longitudinal end wall upper portions 214 connected to the lower portions 212 by longitudinally extending steps 216. By this feature, a horizontal cross-section of the space 208 within the container 200 taken at increasing distances from the base 202 lengthens abruptly at the steps 216 as upper portions 214 are spaced further from each other by the length of the steps 216 relative to the lower portions 212. The lengthening and widening of the upper end of the container 200 provides an upper opening 218 that is enlarged relative to the base 202 for easy access to the interior space 208.

The end wall lower portions 212, on opposing sides of the base 202, may diverge from each other with increasing distance from the base 202, such that the interior space 208 within the container lengthens with increasing distance from the base 202 from the base to the steps 216. Similarly, the end wall upper portions 214 may diverge from each other with increasing distance from the steps 216, such that the container further lengthens from the steps 216 to the upper opening 218. The upper opening is defined in a plane parallel to the lower base 202 by upper edges of the lateral walls 206 and upper edges of the end wall upper portions 214 that terminate together at the same height above the lower base 202.

A lid 222 (FIG. 2) removably snaps into sealed engagement with the container to close the upper opening 218 protecting the interior from contamination and to prevent premature unwanted drying of articles 100 in the container 200. In an exemplary packaging arrangement (FIG. 3A), donnable articles 100 are longitudinally stacked within the container 200 with their palm areas 110, and two planar panels 102 overall, disposed essentially vertically so as to effectively hang within the container, with each article 100 in a flat configuration. Each donnable article 100 is disposed in a vertical plane perpendicular to the horizontal plane of the upper opening 218, advantageously permitting withdrawal of each donnable article 100 through the opening 218 in a flat configuration of the article. In the illustrated embodiment, the open wrist bands 106 are oriented toward the opening 218 of the container 200, their terminal ends defining a horizontal plane, for convenient donning by a user. Thus, with the base 202 of the container 200 oriented downwardly and the opening 218 oriented upwardly, the wrist bands 106 are oriented upwardly with the palm areas 110 hanging in the container below the wrist bands.

As provided to the consumer, a sufficient number of articles 100 are provided with adjacent articles touching so as to longitudinally fill the horizontal dimension of the interior space 208 of the container 200 between the end wall lower portions 212. The articles do not fill the longer horizontal dimension between the end wall upper portions 214, such that open spaces are above the steps 216. The lengthening of the container 200 at the steps 216 between the longitudinal end wall upper portions 214 assures room for a user to manually separate adjacent articles so as to grasp and remove an article from the container, even when the container is essentially full and the articles 100 tightly stacked. In at least one example, the wrist bands 106 are provided in a dry condition and the lower areas of the articles 100 are provided in a wetted condition. The vertical disposition of the articles 100 in the container 200 in that example maintains the wrist bands 106 in a dry condition.

A pair of longitudinally extending rods having ends 220 shown in FIG. 3B are passed through the mounting holes 120 of the separable tabs 114 (FIG. 1, 3B) to tentatively retain each article 100 in the stack until intentionally removed by a user. A user removes an article from the container by grasping a wrist band 106 and breaking the tear lines 116 while withdrawing the article from the stack. The enlarged opening 218 does not create splatter or mist upon removal of article 100 from the container 200 as can sometimes occur when removing a wipe from a package through a narrow slit. The separated tabs 114 are expected to remain attached to the longitudinally extending rods. In at least one example, the donnable articles 100 in the container 200 are provided premoistened, wetted or saturated with a selected liquid or gel such as a soap, a solvent, an oil, or any desired fluid or flowable material. In at least one embodiment, the donnable articles 100 in the container 200 are provided as dry allowing a user to select any desired product, such as a cleaning solution, to add to the container to prepare the articles for use as desired in a moistened, wetted, or soaked condition.

A refill stack of donnable cleaning articles in a dry condition or a wetted condition, for example wetted in cleaning solution, may be provided within a soft packaging material for reloading of the container. The articles may be maintained as a stack in such packaging material by longitudinal rods passed through mounting holes. A user can reload the container 200 by removing a refill stack from the soft packaging material and dropping the refill stack into the container. The lid 218 can be snapped into place until an article 100 is needed for use. A variety of containers and/or refill stacks may be provided for various uses. For example, kitchen cleaning kits, automobile cleaning kits, diaper changing kits, and window cleaning kits may all be provided, the donnable articles of each having particularly suited outer surface textures and wetting solutions.

While the embodiments have been described in connection with the preferred embodiments of the various figures, it is to be understood that other similar embodiments may be used or modifications and additions may be made to the described embodiments for performing the same function without deviating therefrom. Therefore, the disclosed embodiments should not be limited to any single embodiment, but rather should be construed in breadth and scope in accordance with the appended claims.

What is claimed is:

1. An assembly comprising:

a container having a base and walls connected to the base to define an interior space, the walls having upper edges that terminate in a plane and define an opening for access to the interior space;

wetted donnable articles stacked within the container, each article in a flat configuration at least partially perpendicular to the opening permitting withdrawal of any one of the donnable articles through the opening in a flat configuration;

panels extending across between and supported by the upper edges of two opposing walls the container, each panel receiving and supporting one of the wetted donnable articles;

two separable tabs respectively formed at upper outer corners of each panel, each tab breakably attached to a respective lateral side of the panel by a respective perforated tearable line, the respective perforated tearable lines being horizontally spaced-apart by a remaining portion of the panel such that the two separable tabs remain disposed on opposing sides of the container after the donnable article is removed from the container while the remaining portion of the panel is removed along with the donnable article, the remaining portion of the panel providing a surface for being grabbed by a user.

2. An assembly according to claim 1, wherein at least one donnable article is configured for donning upon the hand of a user.

3. An assembly according to claim 2, wherein the at least one donnable article is wetted with a cleaning liquid.

4. An assembly according to claim 2, wherein the at least one donnable article comprises a cleaning mitt having an open wrist band and a palm area for receiving the palm of the hand of a user through the open wrist band, and wherein the wrist band is in a dry condition relative to the palm area.

5. An assembly according to claim 2, wherein the at least one donnable article comprises:

two planar panels joined together along a peripheral edge forming a partial enclosure open along a terminal wrist band;

a palm area connected to the wrist band for receiving a palm of a hand of a user;

a thumb area extending from the palm area; and a finger area extending from the palm area.

6. An assembly according to claim 5, wherein the at least one donnable article comprises at least one separable tab breakably attached to the wrist band and connected to the container.

7. An assembly according to claim 5, wherein the partial enclosure defined by the two planar panels opens through the terminal wrist band and toward the opening of the container.

8. An assembly according to claim 1, wherein each tab has a mounting hole by which the tab is connected to the container.

9. An assembly according to claim 1, wherein walls on opposing sides of the base diverge from each other with increasing distance from the base, such that the interior space widens gradually toward the opening.

10. An assembly according to claim 1, wherein walls on opposing sides of the base have lower portions connected to the base and upper portions connected to the lower portions by steps that lengthen the interior space abruptly.

11. An assembly comprising:

a container having a horizontal base and at least partially vertical walls connected to the base to define an interior space, the walls having upper edges that terminate at an opening for access to the interior space;

wetted articles within the container, each article hanging in a respective vertical plane and individually accessible through the opening permitting withdrawal of any one of the articles through the opening in a flat configuration;

panels extending across between and supported by the upper edges of two opposing walls of the container, each panel receiving and supporting one of the wetted articles;

two separable tabs respectively formed at upper outer corners of each panel, each tab breakably attached to a respective lateral side of the panel by a respective perforated tearable line, the respective perforated tearable lines being horizontally spaced-apart by a remaining portion of the panel such that the two separable tabs remain disposed on opposing sides of the container after the wetted article is removed from the container while the remaining portion of the panel is removed along with the donnable article, the remaining portion of the panel providing a surface for being grabbed by a user.

12. An assembly according to claim 11, wherein walls on opposing sides of the base are inclined away from each other with increasing distance from the base, such that the interior space widens gradually toward the opening.

13. An assembly according to claim 11, wherein walls on opposing sides of the base have lower wall portions connected to the base and upper wall portions connected to the lower wall portions by steps that lengthen the interior space abruptly.

14. An assembly according to claim 13, wherein the articles fill a horizontal dimension of the interior space of the container between the lower wall portions.

15. An assembly according to claim 14, wherein the articles do not fill a horizontal dimension of the interior space between the upper wall portions, such that open spaces in the interior space are above the steps.

16. An assembly according to claim 15, wherein each article hangs in a respective vertical plane perpendicular to the horizontal dimension.

17. An assembly according to claim 11, wherein said separable tab has a mounting hole by which said separable tab is connected to the container.

18. An assembly according to claim 11, wherein each wetted article comprises:

wherein each panel defines a peripheral edge forming a partial enclosure open along a terminal wrist band;

a palm area connected to the wrist band for receiving a palm of a hand of a user;

a thumb area extending from the palm area; and a finger area extending from the palm area.

* * * * *